United States Patent [19]

Knaus

[11] 4,277,193

[45] Jul. 7, 1981

[54] HAIR GROOMING DEVICE

[76] Inventor: Ray Knaus, 5565 Wilson Dr., Mentor, Ohio 44060

[21] Appl. No.: 58,627

[22] Filed: Jul. 18, 1979

Related U.S. Application Data

[63] Continuation-in-part of Ser. No. 876,936, Feb. 10, 1978, abandoned.

[51] Int. Cl.[3] ..... A46B 11/00; A46B 15/00

[52] U.S. Cl. ..... 401/39; 132/120; 132/148; 132/151; 401/183; 401/269; 401/281; 401/287

[58] Field of Search ..... 132/85, 151, 147, 120, 132/121, 108-116, 148; 401/22, 16, 36, 37, 39, 183-186, 195, 268, 269, 285, 286, 287, 288, 291, 270, 275, 277, 280, 281; 15/175, 184, 185; 222/553

[56] References Cited

U.S. PATENT DOCUMENTS

| | | | |
|---|---|---|---|
| 1,107,537 | 8/1914 | McCann | 132/108 X |
| 1,346,137 | 7/1920 | Silverthorne | 222/553 |
| 1,590,267 | 6/1926 | Trester | 15/185 |
| 2,299,296 | 10/1942 | Battle | 132/120 |
| 2,400,723 | 5/1946 | Vrana | 132/120 |
| 2,565,889 | 8/1951 | Schroer | 132/112 |
| 2,617,431 | 11/1952 | Gaspari | 401/291 X |
| 2,827,650 | 3/1958 | Morrill et al. | 401/186 |
| 2,852,800 | 9/1958 | Wagner | 15/185 X |
| 2,865,383 | 12/1958 | Kaley | 132/120 X |
| 3,059,652 | 10/1962 | Thomas | 132/112 |
| 3,073,320 | 1/1963 | Seaver | 401/121 |
| 3,308,500 | 3/1967 | Woodruff | 119/85 X |
| 3,419,021 | 12/1968 | Ruffin | 132/112 |

FOREIGN PATENT DOCUMENTS

| | | | |
|---|---|---|---|
| 638038 | 4/1962 | Italy | 401/186 |

*Primary Examiner*—Steven A. Bratlie
*Attorney, Agent, or Firm*—Fay & Sharpe

[57] ABSTRACT

A hair grooming device includes a brush head surrounded by a rotatable cover member having a lateral opening through which bristles on the brush head are exposable. A handle for the brush head includes a reservoir for a liquid treating agent and communicates through a passage in the brush head with small dispensing holes spaced among the bristles. The cover member is rotatable between a bristle exposed position in which the bristles are exposed through the lateral opening, and a bristle storage position in which the bristles are concealed within the cover member. The cover member has comb teeth thereon adjacent the lateral opening, and seals are provided between the brush head and cover member to prevent leakage of treating agent from the bristles in the bristle storage position of the cover member.

12 Claims, 5 Drawing Figures

HAIR GROOMING DEVICE

BACKGROUND OF THE INVENTION

This application is a continuation-in-part of U.S. Patent application Ser. No. 876,936 filed Feb. 10, 1978, now abandoned.

This application relates to the art of hair grooming devices and, more particularly, to such devices which are capable of combing or brushing the hair while adding a liquid treating agent thereto. The invention is particularly applicable to a combination brush and comb, and will be particularly described with reference thereto. However, it will be appreciated that certain aspects of the invention may be used with a brush or a comb alone, and that certain features of the combined brush and comb may be used without an arrangement for dispensing a liquid treating agent.

The use of aerosols for imparting treating agents or grooming aids to the hair is quite expensive. Both aerosols and manual sprays are rather messy because overspray frequently results in deposits of treating agent on a person's face or clothing. Spray applications of liquid treating agent to the hair also tends to wet only the surface of the hair and it is difficult to obtain uniform wetting of the entire hair mass. Applying liquid treating agent to the hands and then transferring the agent from the hands to the hair is very messy and still difficult to achieve uniform wetting because much of the agent clings to the first mass of hair touched by the hands.

Prior devices for wetting the hair with a liquid treating agent without the use of sprays and without wetting the hands include those disclosed in U.S. Pat. Nos. 2,299,296 issued Oct. 20, 1942, to Battle; 2,617,431 issued Nov. 11, 1952, to Gaspari; and 2,865,383 issued Dec. 23, 1958, to Kaley. In these devices, the brush and comb, or the comb and fibrous material, are mounted on a common head at spaced locations. This makes the head very bulky. Liquid treating agent is supplied to the brush or fibrous material which is exposed at all times, even when the comb alone is being used. The wet brush or fibrous material is always exposed and this makes it inconvenient to carry the device in a handbag or the like. In addition, liquid treating agent can leak from the brush or fibrous material while the comb alone is being used, and the treating agent may fall upon a person's clothes or otherwise be a nuisance.

Other grooming devices for imparting a liquid treating agent to a comb or applicator tool include U.S. Pat. Nos. 3,073,320 issued Jan. 15, 1963, to Seaver; and 3,419,021 issued Dec. 31, 1968, to Ruffin. In these devices, an applicator tool or comb is inserted into a pocket or reservoir for being wetted with a liquid treating agent. The comb is then removed from the pocket or reservoir to transfer the agent to the hair.

Other known devices for either brushing or combing the hair includes U.S. Pat. Nos. 2,400,723 issued May 21, 1946, to Vrana; and 3,308,500 issued Mar. 14, 1967, to Woodruff. The Vrana device includes a power driven rotatable brush within a housing, and the brush is exposed through a lateral housing opening having comb teeth extending thereacross. The Woodruff device includes a unitary member having both bristles and comb teeth thereon, with the member being pivoted to a housing for movement to different positions for use of either the brush bristles or the comb teeth.

A prior device of general interest is disclosed in U.S. Pat. No. 1,107,537 issued Aug. 18, 1914, to McCann.

This device has an internal chamber filled with fibrous material which is saturated with an anticeptic or insecticidal solution. A spring loaded shutter normally closes an opening through which the fibrous material can be exposed. Comb teeth outwardly of the shutter are intended to deflect bugs or vermin onto the fibrous material.

SUMMARY OF THE INVENTION

A hair grooming device includes a brush head having a handle extending therefrom and being surrounded by a rotatable cover member. Bristles on the brush head are exposable through a lateral opening in the cover member which is rotatable between a bristle exposed position and a bristle storage position.

In a preferred arrangement, comb teeth are provided on the cover member adjacent the lateral opening therein. This makes it possible to selectively groom hair by combing action alone when the cover member is in its bristle storage position, or to perform combined brushing and combing action when the cover member is in the bristle exposed position. The comb teeth are preferably formed integral with the cover member and span the lateral opening therein.

In accordance with another aspect of the invention, the handle includes reservoir means for a liquid hair treating agent. Passageway means extends from the reservoir means to the bristles for supplying liquid treating agent thereto from the reservoir means. In a preferred arrangement, the brush head is hollow and communicates with the reservoir means in the handle. Small lateral dispensing holes in the brush head communicate with the hollow interior thereof for wetting the bristles.

In one arrangement, the reservoir is integral with the handle, at least a portion of which is flexible so it can be squeezed to force liquid treating agent therefrom through the small dispensing holes.

Cooperating locking means is provided between the brush head and cover member for releasably locking the cover member in its bristle exposed or bristle storage positions.

Seal means is provided between the brush head and the cover member for substantially sealing the bristles against leakage of liquid therefrom externally of the cover member when the cover member is in its bristle storage position.

It is a principal object of the present invention to provide an improved hair grooming device which is very economical to manufacture and assemble.

It is another object of the invention to provide a hair grooming device which is capable of wetting hair with a liquid treating agent in a highly efficient manner.

It is an additional object of the invention to provide a hair grooming device which can be carried in a handbag or the like without causing a mess from liquid treating agent carried by the device.

It is a further object of the invention to provide a hair grooming device which can be used for either combing the hair or for brushing and combing the hair, and can also be used for imparting a liquid treating agent to the hair.

It is also an object of the invention to provide a hair grooming device which is capable of combing or brushing the hair while imparting a liquid treating agent thereto, while maintaining the device in a very compact size which can be easily manipulated and transported.

DESCRIPTION OF A PREFERRED EMBODIMENT

Figure 1:
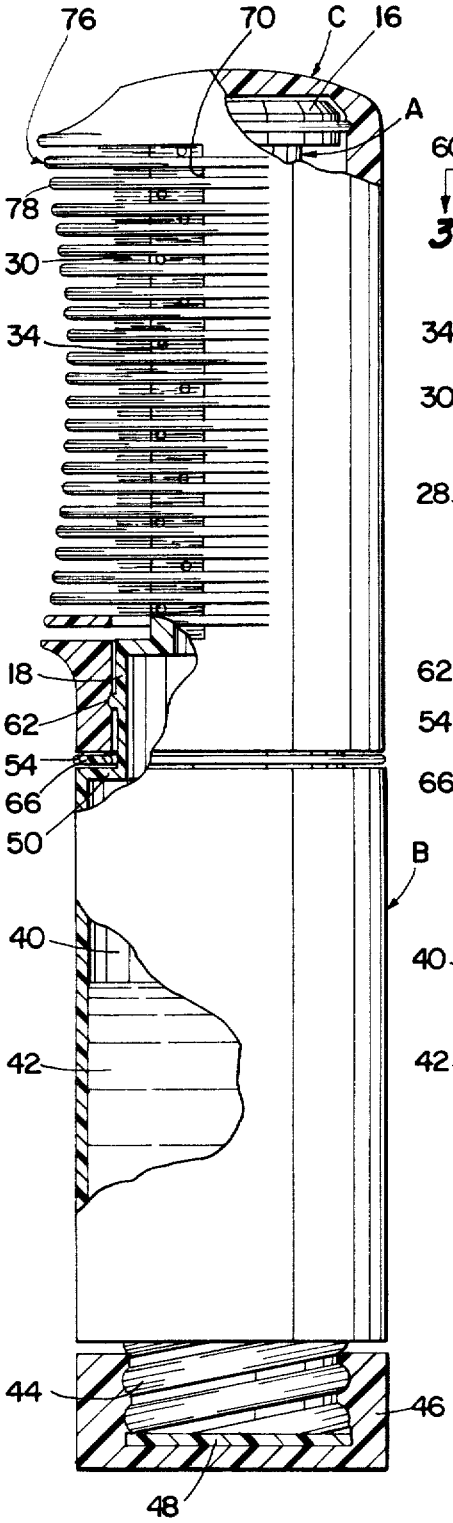
FIG. 1 is a side elevational view of a hair grooming device constructed in accordance with the present application, and with portions cut-away and in section for clarity of illustration.

Referring now to the drawing, wherein the showings are for purposes of illustrating a preferred embodiment of the invention only and not for purposes of limiting same, a hair grooming device includes a brush head A having a handle B extending therefrom, and being surrounded by a rotatable cover member C.

Brush head A includes an elongated hollow tubular portion 12 having a hollow interior 14. Although tubular portion 12 is shown as being generally cylindrical, it will be recognized that it can have other shapes. Brush head A further includes enlarged cylindrical portions 16 and 18 at opposite ends of tubular portion 12. Enlarged cylindrical portions 16 and 18 have substantially the same diameter, and that diameter is substantially larger than the diameter of tubular portion 12. Brush head A further includes opposite outwardly projecting longitudinal flanges 20 extending between enlarged cylindrical portions 16 and 18. The outer surfaces of flanges 20 preferably lie on the periphery of a cylinder having the same diameter as the diameter of cylindrical portions 16 and 18.

Outwardly extending circumferential beads 24 and 26 are provided on cylindrical portions 16 and 18. Outwardly extending longitudinally beads 28 are provided on the outer longitudinal surfaces of flanges 20 between the beads 24 and 26. Beads 24, 26 and 28 are preferably smoothly rounded.

Tubular portion 12 of brush head A has opposite sides extending between flanges 20. One of those sides is provided with outwardly extending brush bristles 30 secured thereto in a conventional manner as by drilling bores in the wall of tubular portion 12 and adhesively securing bunches of bristles therein. Bristles 30 are preferably of a relatively high density throughout the one surface of tubular portion A so that the brush is relatively thick. If desired, it would also be entirely possible to form the bristles integral with brush head A without in any way departing from the overall intent of the invention. In the arrangement shown, flanges 20 are directly opposite one another and bristles 30 extend completely between those flanges. Thus, bristles 30 extend over an arc of approximately 160°. However, it will be recognized that it is possible to extend the bristles over other arcs and that flanges 20 do not have to be located directly opposite one another. Bristles 30 also extend along substantially the entire length of tubular portion 12 between cylindrical portions 16 and 18. The ends of bristles 30 preferably lie on the periphery of a cylinder having a diameter substantially the same as, or slightly less than, the diameter of cylindrical portions 16 and 18. The surface of tubular portion 12 on the opposite side thereof from bristles 30 is smooth and spaced well inwardly from the outer longitudinal surfaces of flanges 20.

Tubular portion 12 of brush head A is provided with a plurality of small lateral dispensing holes 34 communicating with the hollow interior 14 thereof and extending to the outer surface of tubular portion 12 on which bristles 30 are provided. Dispensing holes 34 are distributed among bristles 30 by being spaced-apart throughout tubular portion 12 on which bristles 30 are provided. Dispensing holes 34 are preferably very small and are generally of the type commonly referred to as pin holes. Dispensing holes 34 are preferably small enough that water or other liquid will not flow therethrough from hollow interior 14 of tubular portion 12 unless the liquid is under substantial pressure. That is, dispensing holes 34 are of such a size that water would not normally flow therethrough by gravity or when the hair grooming device is manipulated and shaken as is normally done in combing or brushing the hair. In addition, the density of bristles 30 is such that liquid flowing outwardly through dispensing holes 34 is trapped by bristles 30 and retained therein until the liquid is positively removed therefrom by passing the bristles through hair. The liquid travels along bristles 30 to the tips of the bristles by wicking action so that liquid is distributed along the length of the bristles. In addition, the density of the bristles helps to retain the liquid in the bristles until hair is passed therethrough.

Handle B is illustrated in the preferred embodiment as being formed integrally with brush head A. However, it will be recognized that handle B can be formed separately from brush head A and secured thereto as by threading or the like. Handle B has a hollow interior 40 defining reservoir means for a liquid hair treating agent 42 of any suitable type including water or hair conditioner. The bottom of handle B has an externally threaded neck 44 through which communication is provided to reservoir means 40. An internally threaded cap member 46 having a gasket 48 threadably receives neck 44 to close reservoir means 40. Cap 46 may be removed and replaced at will be refilling reservoir means 40 or changing the contents thereof.

In the arrangement shown, handle B is cylindrical and of a larger diameter than the diameter of cylindrical portion 18 on brush head A. Therefore, handle B merges into cylindrical portion 18 at a radial circumferential flat shoulder 50.

Hollow interior 14 of tubular portion 12 on brush head A communicates with the hollow interior of handle B defined by reservoir means 40. Thus, hollow interior 14 and dispensing holes 34 define passageway means for carrying liquid hair treating agent from reservoir means 40 to bristles 30. Handle B is molded of flexible plastic material so it can be squeezed to force liquid 42 therefrom into hollow interior 14 of tubular portion 12 on brush head A and then out through dispensing holes 34 to bristles 30. It will be recognized that it is possible to mold handle B such that only a portion thereof has a wall flexible enough to be squeezed instead of the entire handle being collapsible. Handle B can also be in the form of a separate container with its neck threadable into internal threads which would be provided on the interior of cylindrical portion 18. Obviously, many other arrangements for providing reservoir means on the handle of the grooming device are also possible.

Cover member C is generally cylindrical, and has one open end 54 and one closed end 56. The internal diameter of cover member C is preferably approximately the same as the outer diameter of cylindrical portions 16 and 18. Cover member C has inner circumferential grooves 60 and 62 adjacent the opposite ends thereof for closely receiving circumferential beads 24 and 26 on cylindrical portions 16 and 18. Cover member C is molded of plastic material which has sufficient flexibility to force cover member C down over beads 24 and 26 until such beads snap into grooves 60 and 62. This releasably secures cover member C to brush head A while allowing relative rotation between cover member C and brush head A. A gasket 66 of elastomeric material is positioned on shoulder 50 for engaging the end of cover member C when beads 24, 26 are received in grooves 60, 62.

Cover member C has a generally rectangular lateral opening 70 therein. The length of lateral opening 70 parallel to the longitudinal axis of brush head A is approximately the same as the length of tubular portion 12 on brush head A between cylindrical portions 16, 18. The arc over which lateral opening 70 extends is approximately the same as the arc over which bristles 30 extend.

A plurality of arcuate comb teeth 76 are formed integrally with cover member C and span lateral opening 70. Comb teeth 76 are spaced-apart from one another in a direction parallel to the longitudinal axis of cover member C and brush head A. The internal surfaces of comb teeth 76 follow the cylindrical inner surface of cover member C as clearly shown in FIGS. 2 and 5. The external surfaces of comb teeth 76 project outwardly beyond the outer cylindrical periphery of cover member C as indicated at 78. Instead of having comb teeth span lateral opening 70, it will be recognized that it is possible to have comb teeth extending outwardly from cover member C adjacent lateral opening 70. It is also possible to provide comb teeth on cover member C by attaching same thereto instead of forming them integral with the cover member.

Figure 2:
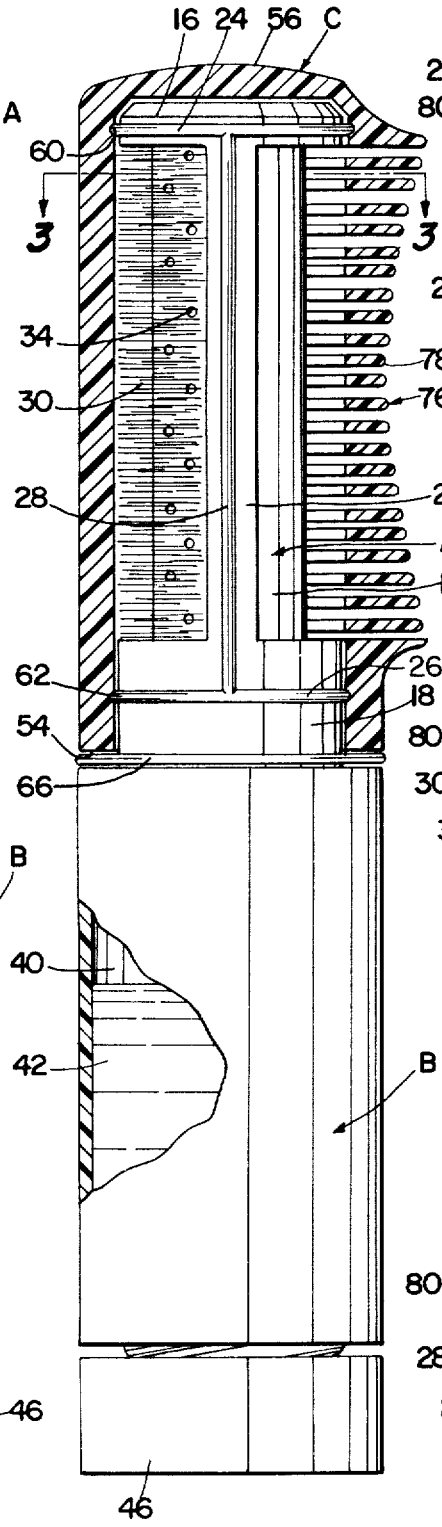
FIG. 2 is a partial cross-sectional elevational view taken generally on line 2—2 of FIG. 5 and showing a cover member located in a bristle storage position.
Figure 3:
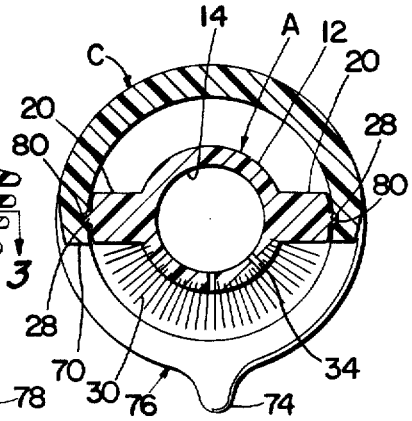
FIG. 3 is a cross-sectional plan view taken generally on line 3—3 of FIG. 2, with FIG. 3 being rotated clockwise 90°, and with the internal brush head rotated 180° to a bristle exposed position.
Figure 5:
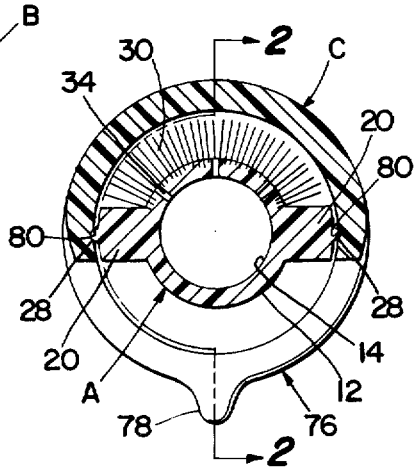
FIG. 5 is a view similar to FIG. 3, and showing the brush head and cover member rotated to a bristle storage position.

The internal peripheral surface of cover member C has opposite longitudinal grooves 80 extending between circumferential grooves 60, 62. Longitudinal grooves 80 are dimensioned for closely receiving outwardly extending beads 28 on flanges 20 of tubular portion 12 on brush head A. Cover member C and brush head A are rotatable relative to one another for locating cover member C in a brush exposed or a brush storage position. Cover member C is shown in the brush exposed position in FIGS. 1 and 3 wherein lateral opening 70 in cover member C is aligned with brush bristles 30. In this position, longitudinal beads 28 on flanges 20 are received in longitudinal grooves 80 in cover member C. This releasably locks cover member C in position against relative movement with respect to brush head A. Thus, the longitudinal beads and grooves cooperate with one another to define releasable locking means for releasably locking the cover member and brush head against relative rotation in the bristle exposed or bristle storage positions. In the bristle exposed position of cover member C, the hair grooming device may be passed through hair while handle B is squeezed to force liquid hair treating agent into the bristles. Hair passing through the bristles is uniformly wetted with the treating agent. The comb teeth and brush bristles act simultaneously on the hair when cover member C is in the bristle exposed position. When it is simply desired to comb the hair without having any brushing action or without wetting the hair, cover member C is rotated to the bristle storage position shown in FIGS. 2 and 5. Cover member C has sufficient flexibility to allow forcing of beads 28 out of grooves 80 and to permit relative rotation between the cover member and brush head 180° until the longitudinal beads and grooves again interfit for releasably locking the cover member in the bristle storage position. The circumferential beads and grooves, along with the longitudinal beads and grooves, act as seal means in the storage position of bristles 30 to prevent leakage of liquid therefrom. In the bristle storage position of cover member C, bristles 30 are substantially completely concealed and sealed within cover member C as shown in FIGS. 2 and 5. Thus, the cooperating circumferential beads and grooves perform the dual functions of sealing and holding cover member C rotatably to brush head A. The longitudinal beads and grooves perform the dual functions of releasably locking cover member C in its bristle storage or bristle exposed positions, while also forming seal means in the bristle storage position.

Figure 4:
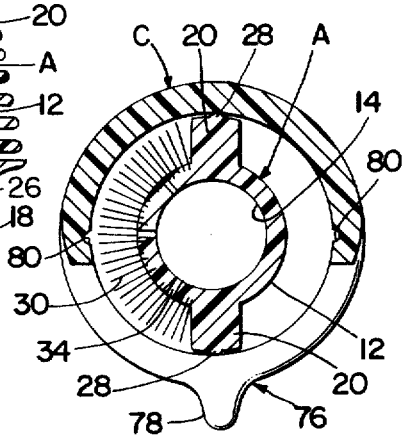
FIG. 4 is a view similar to FIG. 3, and showing the external cover member and the internal brush head relatively rotated to an intermediate position between the bristle storage and bristle exposed positions.

FIG. 4 shows the positions of the brush head and cover member when they are intermediate the bristle storage and bristle exposed positions.

In the arrangement shown and described, handle B and brush head A extend along a common longitudinal axis. Cover member C rotates about that axis between a bristle storage and bristle exposed position. Comb teeth 76 are spaced radially outwardly from that axis and also project outwardly of the axis a distance greater than the outer surface of cover member C. In the bristle exposed position of cover member C, lateral opening 70 is aligned with bristles 30. In the bristle storage position of cover member C, bristles 30 are out of alignment with lateral opening 70, and lateral opening 70 is positioned on the opposite side of brush head A from bristles 30.

Comb teeth 76 are shown projecting outwardly beyond the outer periphery of cover member C at 78. The projecting portions 78 are centrally located relative to lateral opening 70.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

I claim:

1. A brush including a handle having a brush head extending therefrom, bristles extending outwardly from said head, reservoir means on said handle for a liquid treating agent, passage means from said reservoir means to said bristles for supplying a liquid treating agent to said bristles, a rotatable cover member surrounding said head and having a lateral opening therein, said cover member being rotatable between a bristle exposed position and a bristle storage position, said lateral opening being aligned with said bristles in said bristle exposed position of said cover member, said bristles being out of alignment with said lateral opening and being completely concealed within said cover member in said bristle storage position of said cover member, comb teeth integral with said cover member and spanning said lateral opening generally circumferentially of the longitudinal rotational axis of said cover member, said teeth being spaced outwardly from said brush head to define a space between said teeth and head which is occupied by said bristles in said bristle exposed position of said cover member so that hair is subjected to combined combing and brushing action in said bristle exposed position of said cover member, and said teeth being spaced outwardly from said brush head in said bristle storage position of said cover member to define a free space between said teeth and head which is unoccupied by bristles so that hair is subjected only to combing action by passage of hair through said teeth and through said free space.

2. The brush as defined in claim 1 including releasable locking means between said head and cover member for releasably locking said cover member in said bristle exposed and bristle storage positions.

3. The brush as defined in claim 1 including integral cooperating longitudinal projections on said head and longitudinal grooves on said cover member for receiving said projections to releasably lock said cover member in said bristle exposed and bristle storage positions.

4. The brush as defined in claim 1 including seal means between said head and said cover member for substantially sealing said bristles within said cover member in said bristle storage position of said cover member and thereby preventing leakage of treating agent from said head and bristles externally of said cover member.

5. The brush as defined in claim 1 wherein said head includes axially-spaced cylindrical portions on opposite sides of said bristles defining bearings on which said cover member rotates, said cylindrical portions having outwardly extending circumferential beads and said cover member having inwardly extending circumferential grooves receiving said beads for retaining said cover member on said head.

6. A brush and comb comprising: a handle having a brush head extending therefrom, brush bristles secured to said head and extending outwardly therefrom, a rotatable cover member surrounding said head and bristles and having a lateral opening therein, comb teeth on said cover member adjacent said lateral opening, said cover member being rotatable between a brush exposed position and a brush storage position, said bristles being aligned with said lateral opening in said brush exposed position of said cover member for simultaneous brushing and combing of hair by passage of hair through said comb teeth and into said lateral opening toward said brush head for passage through said bristles, said bristles being concealed by said cover member and being out of alignment with said lateral opening in said brush storage position of said cover member, said comb teeth and said lateral opening being spaced substantially outwardly from said brush head in said brush storage position of said cover member for providing combing action on hair by passage of hair through said comb teeth and into said lateral opening toward said brush head, and integral cooperating releasable locking means between said head and cover member for releasably locking said cover member in either said brush storage position or in said brush exposed position.

7. The brush and comb as defined in claim 6 wherein said comb teeth are integral with said cover member and span said lateral opening.

8. The brush and comb as defined in claim 6 including reservoir means on said handle for a liquid treating agent, and passage means in said head for supplying treating agent from said reservoir means to said bristles.

9. A brush comprising: a handle having a brush head extending therefrom, said head having an elongated hollow tubular portion, enlarged cylindrical portions at opposite ends of said tubular portion, a pair of circumferentially-spaced outwardly projecting longitudinal flanges extending between said cylindrical portions, said tubular portion having brush bristles secured thereto and extending outwardly therefrom between said flanges on one side thereof, a plurality of spaced small lateral holes in said tubular portion among said bristles for establishing communication between the hollow interior of said tubular portion and the exterior thereof, a cover member rotatably mounted on said cylindrical portions in surrounding relationship to said head, said cover member having an enlarged lateral opening through which said bristles are exposable for brushing hair, said cover member being rotatable between a brush exposed position in which said lateral opening is aligned with said bristles and a brush storage position in which said bristles are concealed within said cover member, said handle including reservoir means for supplying a liquid treating agent to said bristles through said tubular portion and said lateral holes, and seal means between the interior surface of said cover member and the exterior surfaces of said flanges and cylindrical portions for sealing said cover member against discharge of liquid treating agent therefrom in said brush storage position thereof.

10. The brush as defined in claim 9 including comb teeth spanning said lateral opening in said cover member.

11. The brush as defined in claim 9 wherein said handle is hollow to define said reservoir and is integral with said head, at least a portion of said handle being flexibly squeezable for discharging liquid treating agent therefrom.

12. The brush as defined in claim 9 wherein said seal means includes outwardly extending beads on the exterior surfaces of said flanges and cylindrical portions, said cover member having grooves for receiving said beads, said grooves including longitudinal grooves in which said beads on said flanges are received in said brush storage and brush exposed positions of said cover member to releasably hold said cover member in said positions.

* * * * *